US010428697B2

(12) United States Patent
Manther et al.

(10) Patent No.: US 10,428,697 B2
(45) Date of Patent: Oct. 1, 2019

(54) FLUID DIVERTER

(71) Applicant: Schaeffler Technologies AG & Co. KG, Herzogenaurach (DE)

(72) Inventors: Debora Manther, Royal Oak, MI (US); John Whitton, Milwaukee, WI (US); Pradeep Mohan Mohan Das, Troy, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 306 days.

(21) Appl. No.: 15/271,869

(22) Filed: Sep. 21, 2016

(65) Prior Publication Data

US 2018/0080349 A1 Mar. 22, 2018

(51) Int. Cl.

| | |
|---|---|
| ***F01L 1/24*** | (2006.01) |
| ***F01L 1/18*** | (2006.01) |
| *F01L 13/00* | (2006.01) |

(52) U.S. Cl.

CPC ..... *F01L 1/24* (2013.01); *F01L 1/18* (2013.01); *F01L 13/0005* (2013.01); *F01L 13/0036* (2013.01); *F01L 2001/186* (2013.01); *F01L 2810/02* (2013.01)

(58) Field of Classification Search

CPC ..... F01L 1/24; F01L 2001/24; F01L 2810/02; F01L 1/18

USPC ..... 123/90.39, 90.52, 90.16, 90.46

See application file for complete search history.

(56) References Cited

U.S. PATENT DOCUMENTS

| | | | | |
|---|---|---|---|---|
| 5,125,373 | A | 6/1992 | Yamada et al. | |
| 6,598,578 | B2 | 7/2003 | Takahashi et al. | |
| 6,810,846 | B2 | 11/2004 | Murata et al. | |
| 2002/0035978 | A1* | 3/2002 | Usko | F01L 1/24 123/90.55 |
| 2005/0016484 | A1* | 1/2005 | Oka | F01L 1/18 123/90.36 |
| 2005/0274343 | A1* | 12/2005 | Nakano | F01L 1/053 123/90.16 |
| 2008/0302322 | A1 | 12/2008 | Edelmayer et al. | |
| 2011/0303174 | A1* | 12/2011 | Ezaki | F01L 1/185 123/90.46 |
| 2017/0022848 | A1* | 1/2017 | Ahmed | F01L 1/24 |

* cited by examiner

*Primary Examiner* — Atif H Chaudry
(74) *Attorney, Agent, or Firm* — Volpe and Koenig, P.C.

(57) ABSTRACT

A fluid diverter including a cylindrical body and an extension arm is provided. The cylindrical body defines a first fluid passage extending from a first axial end of the cylindrical body and a second fluid passage circumferentially offset from the first fluid passage and extending from a second axial end of the cylindrical body. A seepage orifice is defined in the cylindrical body providing a fluid communication path between the first axial end and the second axial end. The extension arm extends from the cylindrical body and includes a locating receptacle dimensioned to receive a fixing element to rotationally and axially fix the fluid diverter.

9 Claims, 5 Drawing Sheets

FLUID DIVERTER

FIELD OF INVENTION

The present invention relates to a fluid diverter, and is more particularly related to an insertable fluid diverter for a fluid gallery.

BACKGROUND

Fluid galleries are utilized in a variety of applications for directing fluid to components via a central chamber. Fluid galleries are typically defined by a hollow cylindrical housing, for example a hollow shaft, including multiple ports. Fluid diverters can be inserted into the housing to divide the internal fluid chamber of the housing into multiple chambers and define passages to specific ports of the housing. One specification application is for use in connection with rocker arm shafts in internal combustion engines, where multiple internal fluid passages can be used to supply pressurized hydraulic fluid to hydraulic lash adjusters as well as actuators in rocker arms used to deactivate the cam lift to certain valves during cylinder deactivation.

One type of fluid diverter requires an interference fit between the fluid diverter and the housing to secure the fluid diverter in place. An interference fit between the fluid diverter and the housing is undesirable due to the debris caused by the interference fit, which results in contamination of the fluid in the fluid gallery, which is particularly concerning in rocker arm shaft applications. Other retention features can be used to secure the fluid diverter in the housing, including radial grooves on either the housing or the fluid diverter. However, these additional retention features increase the costs of the housing or fluid diverter.

It would be desirable to provide an improved fluid diverter that does not require expensive retention features or a retention configuration that causes debris.

SUMMARY

A fluid diverter including a cylindrical body defining passages and an extension arm including a locating feature is provided. The cylindrical body defines a first fluid passage extending from a first axial end of the cylindrical body and a second fluid passage circumferentially offset from the first fluid passage and extending from a second axial end of the cylindrical body. A seepage orifice is defined in the cylindrical body that provides a fluid communication path between the first axial end and the second axial end. The extension arm extends axially from the cylindrical body and includes a locating receptacle dimensioned to receive a fixing element to rotationally and axially fix the fluid diverter. The seepage orifice provides a throttled fluid connection between the first axial end and the second axial end.

In another embodiment, a fluid supply assembly including the aforementioned fluid diverter is provided. The assembly includes a hollow cylindrical housing defining a first port, a second port, and a first opening. The fluid diverter is positioned within the housing and divides the housing into a first chamber including the first port and a second chamber including the second port. A fixing element extends through the first opening of the housing and within the locating receptacle of the extension arm to rotationally and axially fix the fluid diverter with respect to the housing. The first fluid passage of the fluid diverter is aligned with the first port of the housing and the second fluid passage of the fluid diverter is aligned with the second port of the housing. The seepage orifice ensures a continuous flow of fluid between the chambers which helps reduce air pockets and air bubbles in the fluid.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
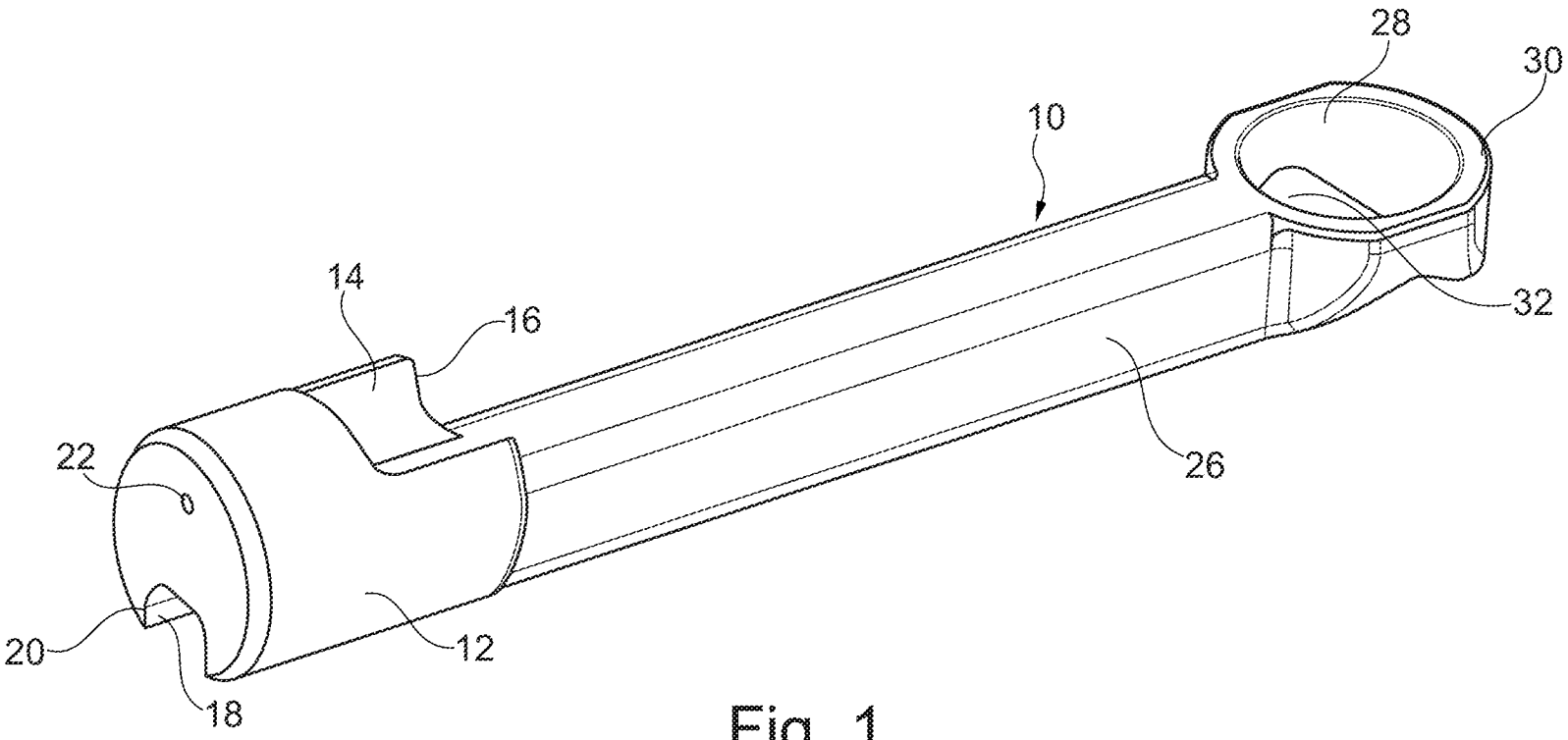
FIG. 1 is a perspective view of a fluid diverter according to a first embodiment.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
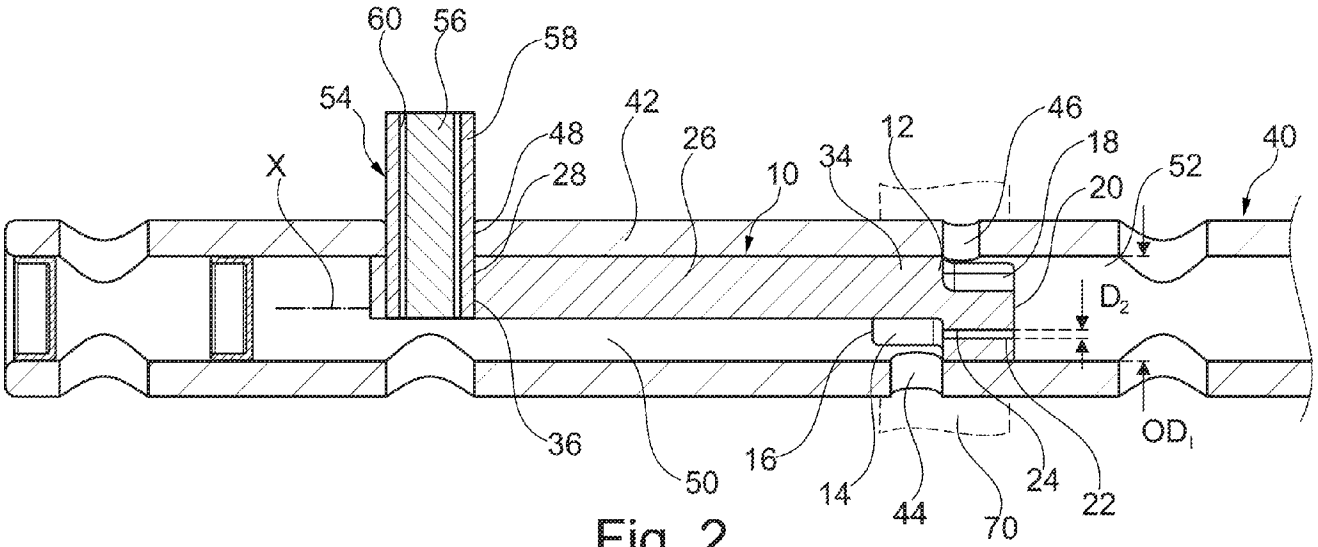
FIG. 2 is a partial view of a cross section the fluid diverter from FIG. 1 arranged within a housing.

Referring to FIGS. 1 and 2, a first embodiment of a fluid diverter 10 is illustrated. The fluid diverter 10 includes a cylindrical body 12 including a first fluid passage 14 that extends from a first axial end 16 of the cylindrical body 12 to a circumferential outer surface and a second fluid passage 18, circumferentially offset from the first fluid passage 14, that extends from a second axial end 20 of the cylindrical body 12 to the circumferential outer surface. A seepage orifice 22 is defined in the cylindrical body 12 and provides a fluid communication path 24 between the first axial end 16 and the second axial end 20 of the cylindrical body 12. The seepage orifice 22 provides a de-aeration feature between adjacent chambers defined within a rocker arm shaft that defines a housing, which is discussed in more detail below.

An extension arm 26 extends from the cylindrical body 12 in an axial direction and includes a locating receptacle 28 dimensioned to receive a fixing element to rotationally and axially fix the fluid diverter 10 in a housing. The locating receptacle 28 comprises a circular rim 30 defining an opening 32 in a direction transverse to an axis (X) of the cylindrical body 12. The extension arm 26 is connected with the cylindrical body 12 at a first end 34, and preferably a second opposite end 36 of the extension arm 26 includes the locating receptacle 28. Preferably, the first fluid passage 14 is located diametrically opposite to the second fluid passage 18. However, the specific circumferential positions could be varied. The cylindrical body 12 defines a first outer diameter ($OD_1$) and the seepage orifice 22 has a second diameter ($D_2$). A ratio between the sizes of the second diameter ($D_2$) and the first diameter ($OD_1$) is selected based on amount of fluid required to maintain a minimum pressure in the fluid passages 14, 18. Other variables for determining this minimum pressure include the flow rate of fluid out of the system and a length of the fluid passages 14, 18. The seepage orifice 22 provides a throttled fluid passage or bleed passage.

As shown in FIG. 2, a fluid supply assembly 40, preferably in the form of a hollow rocker shaft, including the fluid diverter 10 described above is illustrated. The fluid supply assembly 40 includes a hollow cylindrical shaft 42 as the housing having a first port 44, a second port 46, and a first opening 48. As shown in FIG. 2, the first port 44, the second port 46, and the first opening 48 are axially spaced apart in the first embodiment. Additional ports and openings, which are not annotated, are also illustrated on the housing 42. The fluid diverter 10 is positioned within the housing 42 and divides the housing 42 into a first chamber 50 including the first port 44 and a second chamber 52 including the second port 46. One of ordinary skill in the art will recognize from the present disclosure that multiple diverters 10 can be provided within a single housing 42.

Figure 3:
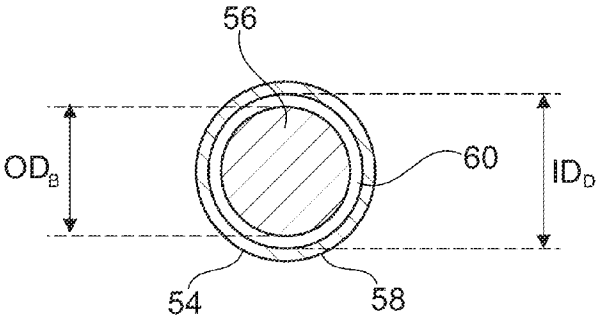
FIG. 3 is cross section view of a dowel and a bolt from FIG. 2.
Figure 6:
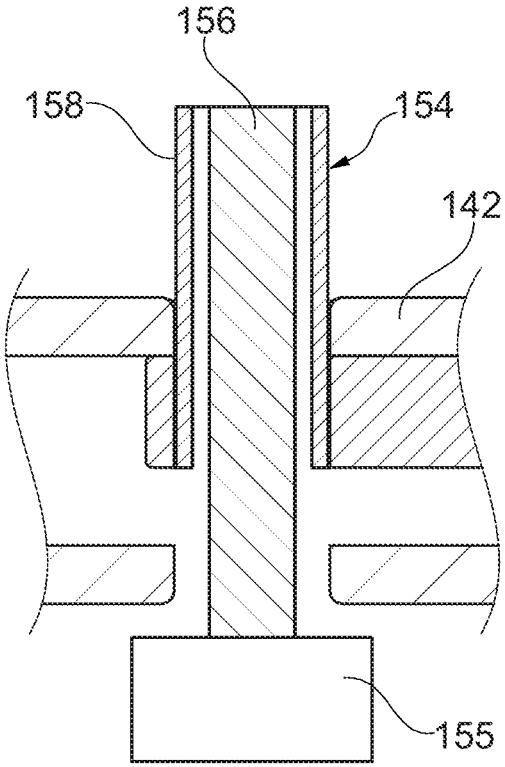
FIG. 6 is a partial view of a bolt extending through a housing.

A fixing element 54 extends through the first opening 48 of the housing 42 and within the locating receptacle 28 of the extension arm 26 to rotationally and axially fix the fluid diverter 10 with respect to the housing 42. The first fluid passage 14 of the fluid diverter 10 is aligned with the first port 44 of the housing 42 and the second fluid passage 18 of the fluid diverter 10 is aligned with the second port 46 of the housing 42. The fixing element 54 comprises a bolt 56 and a dowel 58. As shown in FIGS. 2 and 3, the fixing element 54 comprises a bolt 56 arranged concentric within the dowel 58, and a fluid pathway 60 is defined between an outer diameter ($OD_B$) of the bolt 56 and an inner diameter ($ID_D$) of the dowel 58. As shown in FIG. 2, the fluid pathway 60 extends to the first chamber 50 of the hollow cylindrical housing 42. An opposite end of the fixing element 54 from the locating receptacle 28 can include a fluid supply assembly to provide fluid to the interior of the housing 42. One of ordinary skill in the art will recognize from the present disclosure that alternative fixing elements may be used. In another embodiment shown in FIG. 6, the fixing element 154 includes a bolt 156 and a dowel 158 that extends through the housing 142, and attaches the housing 142 to a base or cylinder head of an internal combustion engine, illustrated generically as element 155.

As shown in FIG. 2, the fluid supply assembly 40 is used in connection with a rocker arm 70, illustrated in broken lines. The housing 42 can be a rocker shaft for switchable rockers. In this embodiment, it is important to de-aerate the chambers 50, 52 to provide reliable functioning of the rocker arm components, i.e. lash adjustment and switching.

Figure 4:
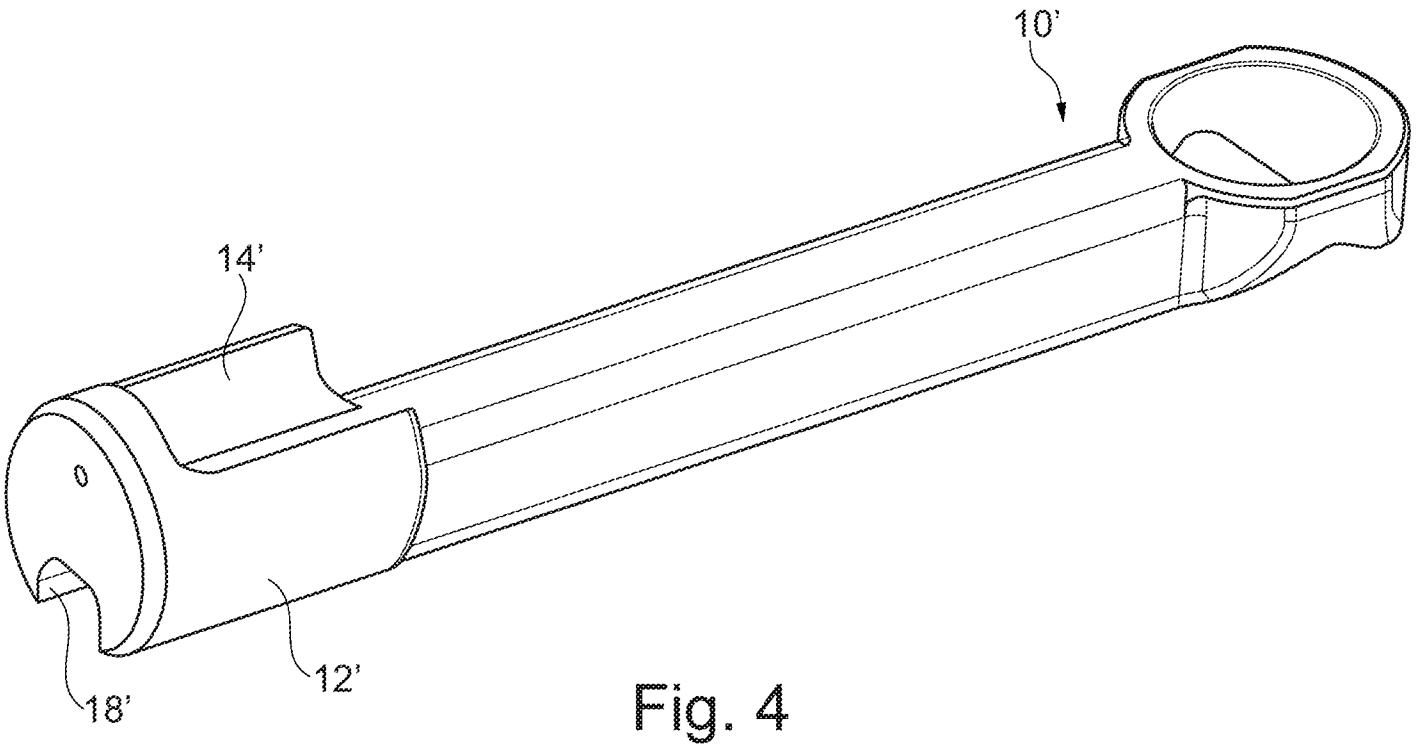
FIG. 4 is a perspective view of a fluid diverter according to a second embodiment.
Figure 5:
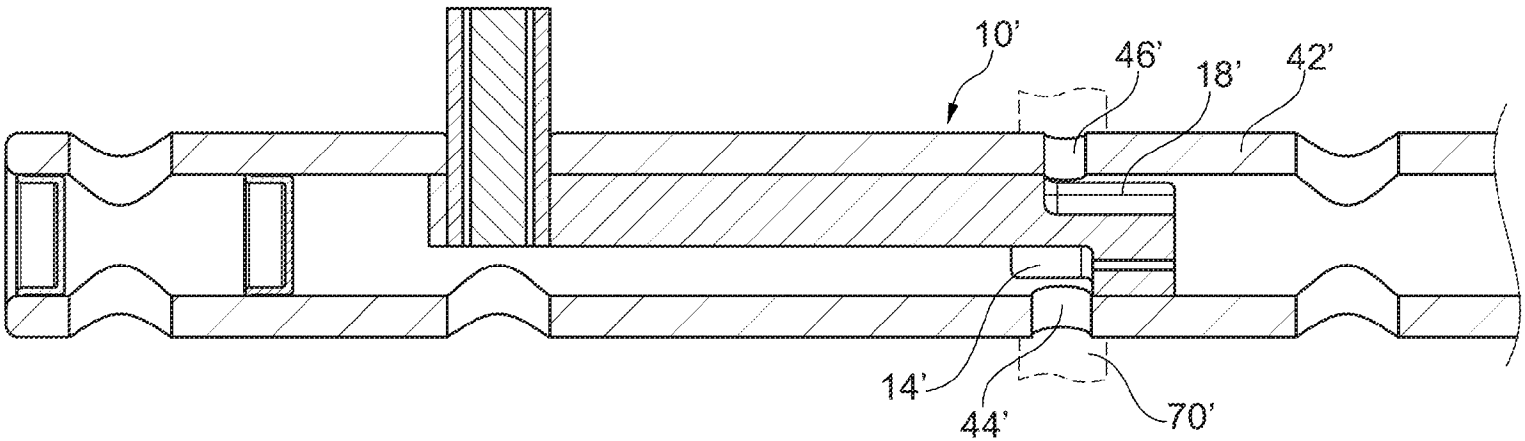
FIG. 5 is a partial view of a cross section the fluid diverter of FIG. 4 arranged with in a housing.

In a second embodiment shown in FIGS. 4 and 5, the first port 44' and the second port 46' of the cylindrical housing 42' are axially aligned, and the first fluid passage 14' and the second fluid passage 18' defined on the cylindrical body 12' of the diverter 10' partially axially overlap. This arrangement is slimmer than the first embodiment and is advantageous for a switchable rocker assembly 70' on a rocker shaft to reduce the axial dimensions of the switchable rocker assembly 70' to reduce the mass, size, and moment of inertia for the switchable rocker assembly. This arrangement helps improve efficiency and increase gas mileage of the associate engine by reducing weight, size, and the moment of inertia of the rocker assembly. One of ordinary skill in the art will recognize from the present disclosure that alternative configurations and positions of the ports, passages, and openings are possible.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A fluid diverter comprising:

a cylindrical body defining a first fluid passage extending from a first axial end of the cylindrical body and a second fluid passage circumferentially offset from the first fluid passage and extending from a second axial end of the cylindrical body, and a seepage orifice defined in the cylindrical body providing a fluid communication path between the first axial end and the second axial end; and an extension arm extending axially from the cylindrical body and including a locating receptacle dimensioned to receive a fixing element to rotationally and axially fix the fluid diverter.

2. The fluid diverter of claim 1, wherein the locating receptacle comprises a circular rim defining an opening in a direction transverse to an axis of the cylindrical body.

3. The fluid diverter of claim 1, wherein the extension arm is connected with the cylindrical body at a first end, and a second opposite end of the extension arm includes the locating receptacle.

4. The fluid diverter of claim 1, wherein the first fluid passage is located diametrically opposite to the second fluid passage.

5. A fluid supply assembly including the fluid diverter of claim 1, and further comprising:

a hollow cylindrical housing defining a first port, a second port, and a first opening, the fluid diverter positioned within the housing and dividing the housing into a first chamber including the first port and a second chamber including the second port;

a fixing element extending through the first opening of the housing and within the locating receptacle of the extension arm to rotationally and axially fix the fluid diverter with respect to the housing, the first fluid passage of the fluid diverter is aligned with the first port of the housing and the second fluid passage of the fluid diverter is aligned with the second port of the housing.

6. The fluid supply assembly of claim 5, wherein the first port, the second port, and the first opening are axially spaced apart.

7. The fluid supply assembly of claim 5, wherein the first port and the second port are axially aligned.

8. The fluid supply assembly of claim 5, wherein the fixing element comprises a bolt and a dowel.

9. The fluid supply assembly of claim 8, wherein the bolt is arranged concentric within the dowel, and a fluid pathway is defined between an outer diameter of the bolt and an inner diameter of the dowel.

* * * * *